US006601674B2

(12) United States Patent
Murray

(10) Patent No.: US 6,601,674 B2
(45) Date of Patent: Aug. 5, 2003

(54) DEVICE FOR STORAGE OF A TOOL

(76) Inventor: Kenneth A. Murray, 2094 Via Del Torrie, Alpine, CA (US) 91901

( * ) Notice: Subject to any disclaimer, the term of this patent is extended or adjusted under 35 U.S.C. 154(b) by 0 days.

(21) Appl. No.: 09/903,117

(22) Filed: Jul. 10, 2001

(65) Prior Publication Data

US 2003/0010570 A1 Jan. 16, 2003

(51) Int. Cl.[7] ..... E04G 5/00; B65D 85/28
(52) U.S. Cl. ..... 182/129; 248/238; 206/372
(58) Field of Search ..... 182/129, 120, 182/121, 206, 214, 107; 248/211, 210, 238, 229.1, 229.16; 206/372, 373

(56) References Cited

U.S. PATENT DOCUMENTS 3,291,521 A * 12/1966 Krueger ..... 248/238 X
3,448,956 A * 6/1969 Kuhaneck, Jr. ..... 248/210
3,642,240 A * 2/1972 Hershey ..... 248/210
3,940,824 A * 3/1976 Giaia et al. ..... 248/210 X
4,300,740 A * 11/1981 Killian ..... 248/238
4,496,058 A * 1/1985 Harris et al. ..... 248/231.8 X
4,979,710 A * 12/1990 Baldwin ..... 248/210
5,079,795 A * 1/1992 Schmid ..... 248/238 X
5,370,246 A * 12/1994 Traynor ..... 206/225 X
5,493,751 A * 2/1996 Misiukowiec et al. .. 248/210 X
5,547,080 A * 8/1996 Klimas ..... 206/373
5,638,915 A * 6/1997 Hardy ..... 182/129
5,842,253 A * 12/1998 Ahl et al. ..... 182/129 X
5,934,112 A * 8/1999 Rice et al. ..... 70/18
5,984,046 A * 11/1999 Urso, Jr. ..... 182/129
5,988,383 A * 11/1999 Armstrong ..... 206/373
6,116,419 A * 9/2000 Campagna et al. ..... 206/373
6,152,300 A * 11/2000 Perkins ..... 206/373
6,364,057 B1 * 4/2002 Cornejo et al. ..... 182/129 X

* cited by examiner

*Primary Examiner*—Daniel P. Stodola
*Assistant Examiner*—Hugh B. Thompson
(74) *Attorney, Agent, or Firm*—David B. Waller

(57) ABSTRACT

A device for securing a tool to a scaffold wherein the device comprises a base having a front side and a back side; an attachment apparatus affixed to the back side for attaching the base to a scaffold; and a holding device connected to the front side and able to accept a tool.

15 Claims, 4 Drawing Sheets

14
16
14
12
10
18
14
12
18
16
10

14
10
12
18

14
12
10
16

14
12
18
16
10

18
10
12
14
16
14

14
16
14
12
10
20
14
14
14
14
12
10
12
10
12
12
20
20
20
16
16
16
10
10

20
10
12
14
16
14

DEVICE FOR STORAGE OF A TOOL

TECHNICAL FIELD

The present invention relates generally to the field of construction and more particularly to a device for securing a tool to scaffold.

BACKGROUND OF THE INVENTION

A scaffold is a system of interconnecting metal bars and platforms installed temporarily usually along walls of a structure such that regions previously inaccessible may be more easily reached. They may be installed indoors or outdoors and vary in size. Generally scaffolds are used in the building industry allowing workers to traverse the structure during construction and repair. Consequently, workers generally use various tools when working with and on scaffolds. These tools are often times bulky, heavy and may contain sharp blades. For example a worker may be required to carry at any given time a number of screwdrivers, hammers, electrical power tools such as an electric drill, tape measure, screws and nails. Because of the number and weight of tools, different techniques are used to access tools when working with a scaffold. Commonly the worker is limited to either transporting tools by hand or by a device such as a tool belt. However, there are disadvantages to each of these methods.

When tools are used one at a time and are transported individually, the construction project is performed more slowly increasing the cost to the contractor. In particular, more time may be required to locate and transport the tool than the time used in performing the tool's function. Because most workers are generally paid hourly a technique that utilizes extensive time becomes costly and inefficient.

In an effort to reduce the time necessary in locating and transporting tools, tool belts have been developed enabling the worker to carry a number of tools simultaneously. Tool belts are generally constructed of heavy-duty leather and are provided in a variety of forms based on the type of tools used by the worker. However, even though these belts allow multiple tools to be carried they do not relieve the worker of the weight resulting from carrying multiple tools.

A third alternative is carrying the multiple tools to the desired location and setting them down. Workers commonly use this technique because of the weight of a fully loaded tool belt. This is often the case when using power tools because they are generally large and heavy. Power tools are usually rested on platforms and are commonly suspended by their cords over the scaffold bars such that the workers do not need to bend over to pick them up. These techniques present dangers caused by falling tools and electrocution.

When tools placed on a platform are not secured there is a danger of the tool falling off the platform and onto someone below. The higher the platform, the more dangerous a falling tool becomes. Although workers generally wear construction helmets, the force exerted from a falling tool may be greater than the protection provided.

When a tool such as a electric power drill is hung over the scaffold bar by its power cord, there is a risk of electrocution if the cord is frayed. A frayed cord, which causes the wires within to contact the scaffolding, could result in electrocution of a worker who touches the scaffold. Correspondingly, if the worker falls he/she may injure others below.

Therefore there is a need for a device that enables a tool to be secured to a scaffold such that the worker does not continually carry the tool, the likelihood of the tool falling from the platform is reduced and the desire to hang the tool from its power cord is eliminated.

SUMMARY OF THE INVENTION

Figures 1A, 1B, 1C, 1D, 1E, 1F:
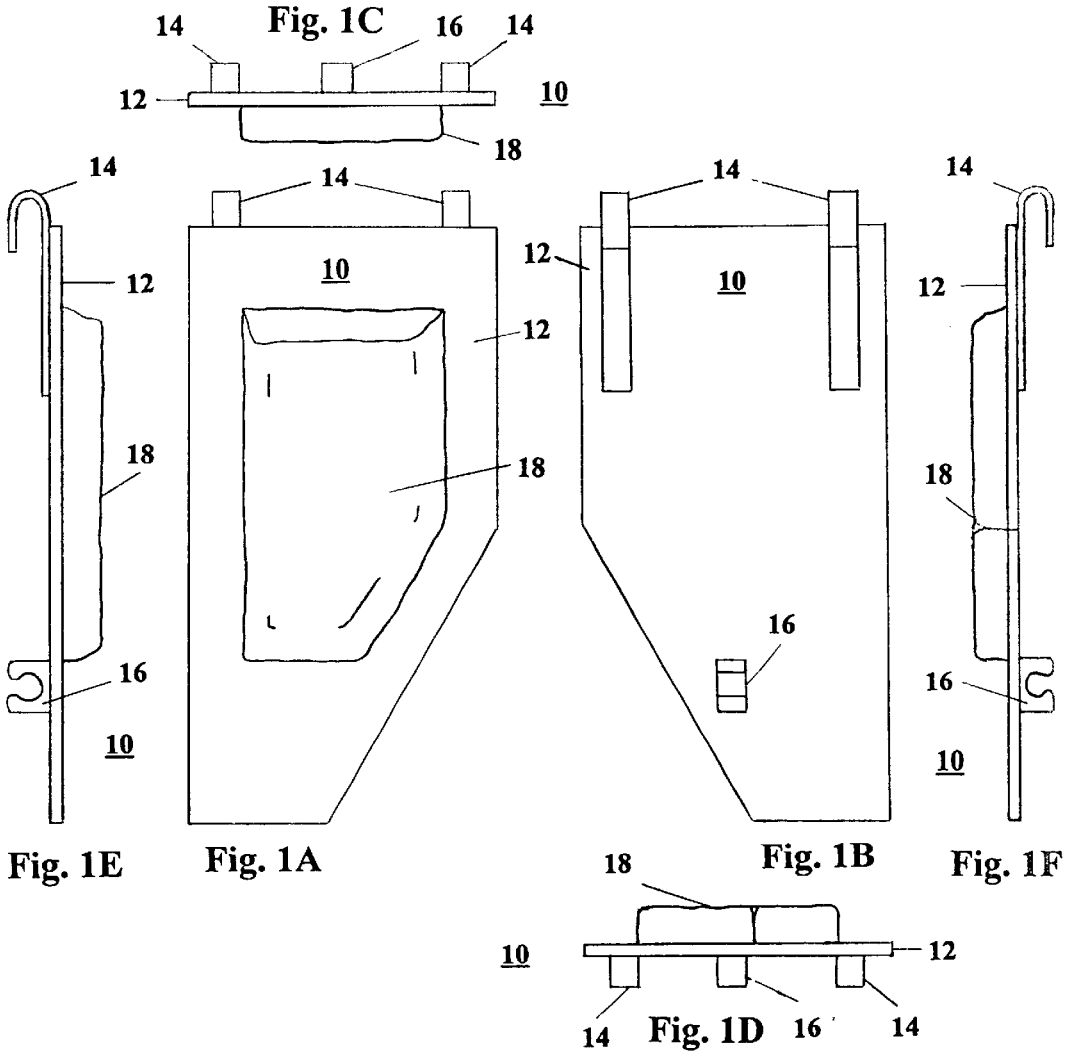
FIG. 1A is a front view of the device for securing a tool to a scaffold of the present invention.
FIG. 1B is a back view of the device for securing a tool to a scaffold of the present invention.
FIG. 1C is a top view of the device for securing a tool to a scaffold of the present invention.
FIG. 1D is a bottom view of the device for securing a tool to a scaffold of the present invention.
FIG. 1E is a left side view of the device for securing a tool to a scaffold of the present invention.
FIG. 1F is a right side view of the device for securing a tool to a scaffold of the present invention.
Figures 2A, 2B, 2C, 2D, 2E, 2F:
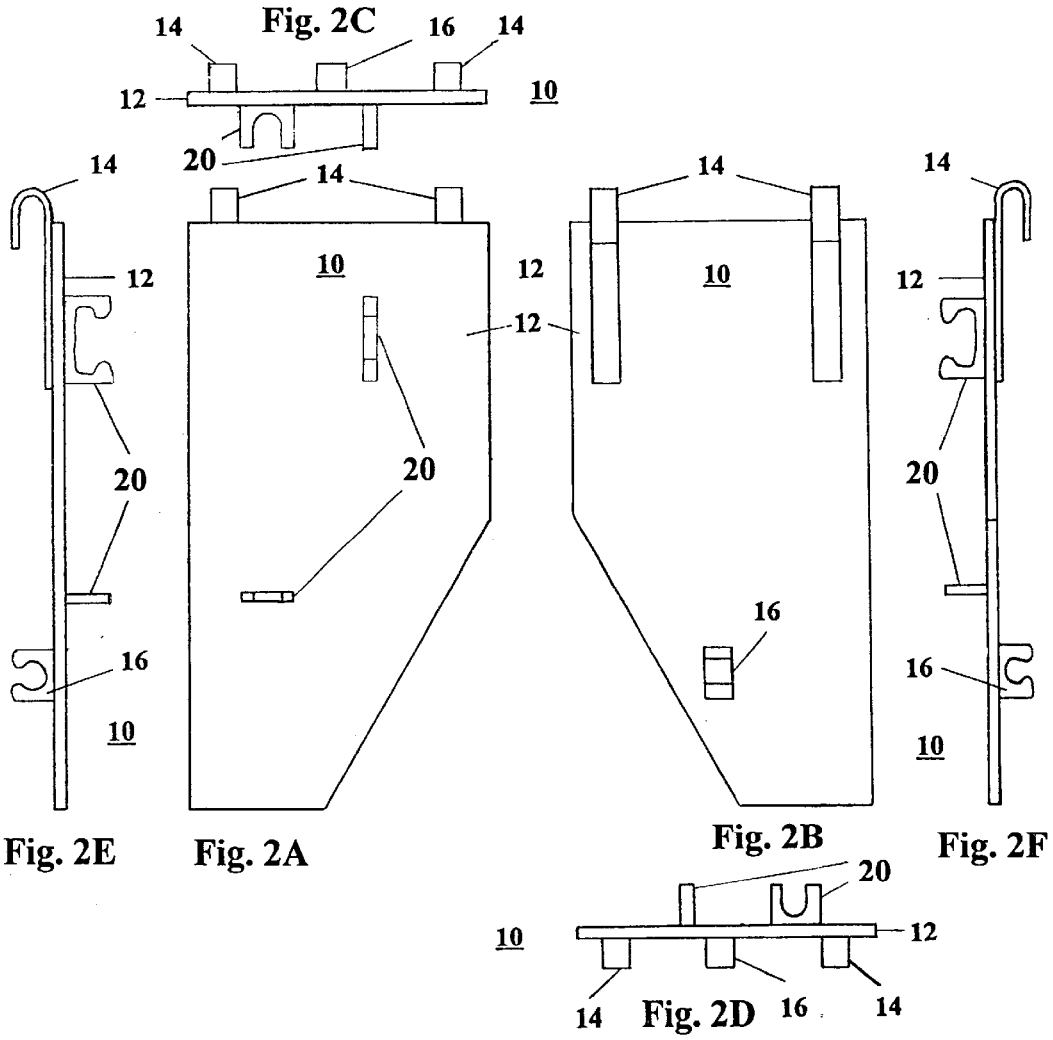
FIG. 2: Is a diagrammatic representation of device for storage of a tool of the present invention having a clamp to secure the tool to the device a front view showing (A); a back view (B); a top view (C); a bottom view (D); a left side view (E) and a right side view (F).
Figures 3A, 3B, 3C, 3D, 3E, 3F:
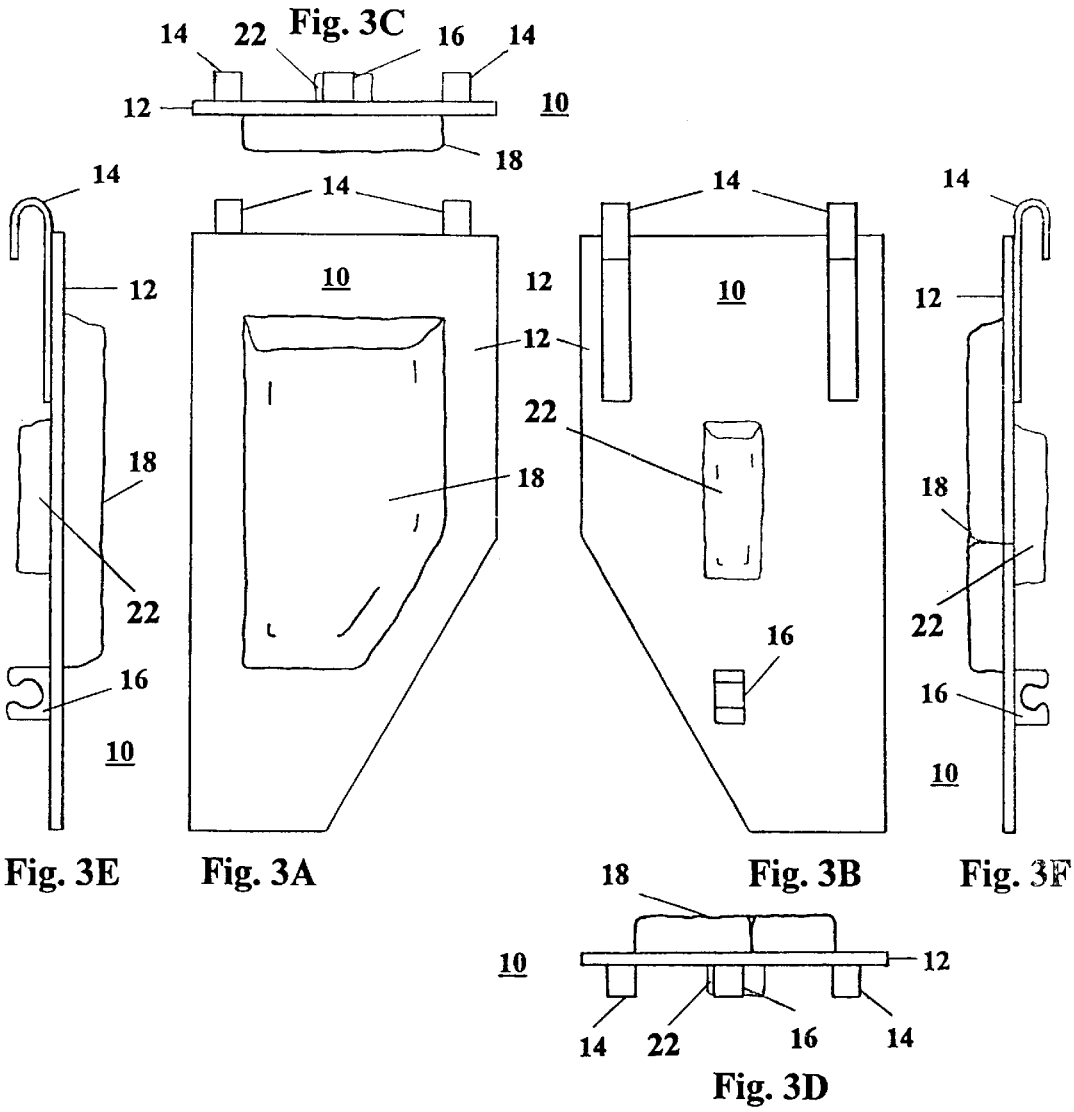
FIG. 3: Is a diagrammatic representation of device for storage of a tool of the present invention having an adapter able to accept a communication device showing a front view (A); a back view (B); a top view (C); a bottom view (D); a left side view (E) and a right side view (F).
Figures 4A, 4B, 4C, 4D, 4E, 4F:
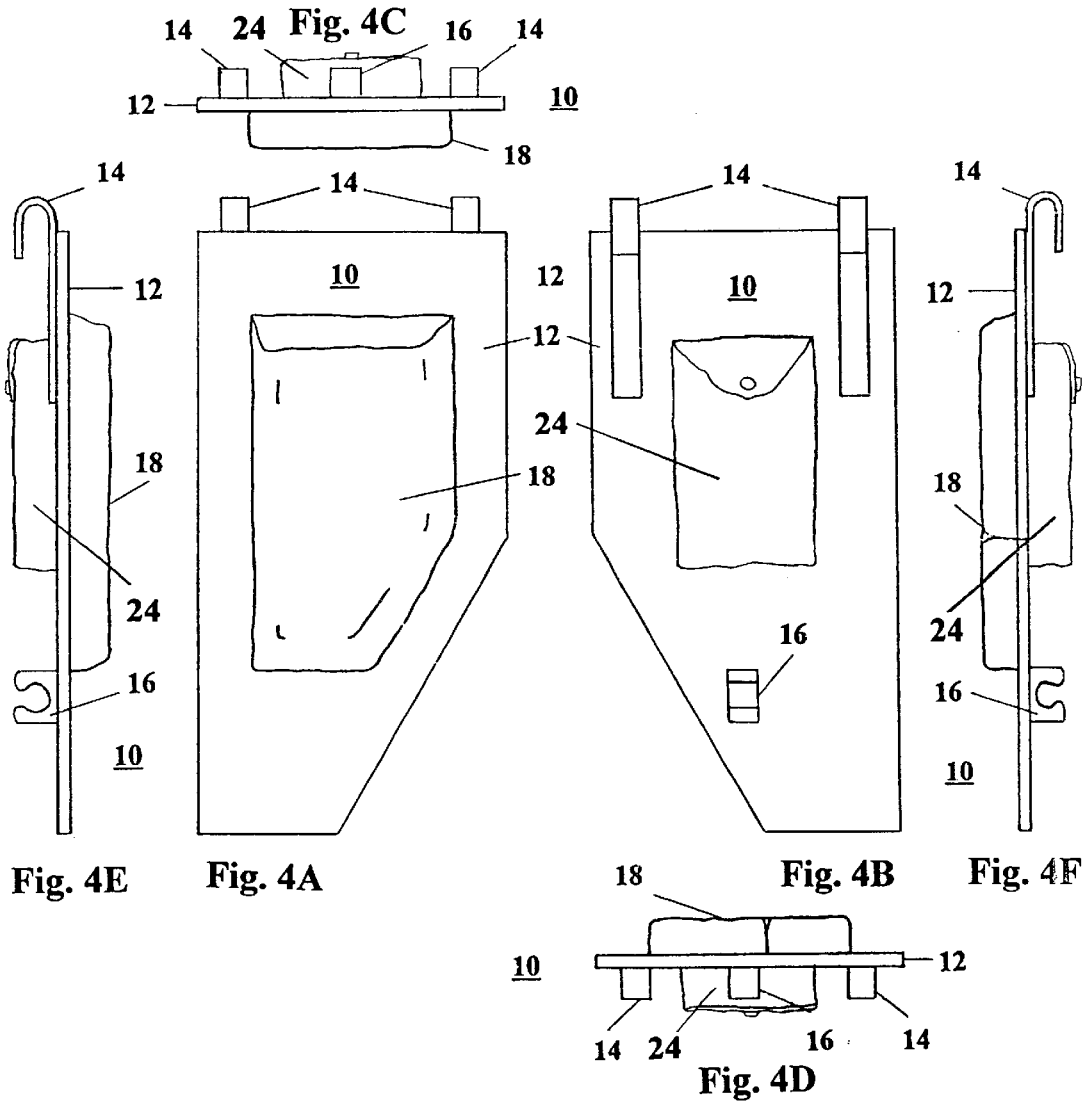
FIG. 4: Is a diagrammatic representation of device for storage of a tool of the present invention having a storage pocket showing a front view (A); a back view (B); a top view (C); a bottom view (D); a left side view (E) and a right side view (F).

In accordance with the present invention a device for securing a tool to a scaffold is disclosed comprising a base having a front side and a back side, an attachment apparatus affixed to the back side for attaching the base to a scaffold, and a holding device connected to the front side and able to accept a tool. The attachment apparatus may further comprise at least one hook able to accept a scaffold bar affixed to the back side. The hook may be adjustably affixed to the back side.

In one embodiment of the present invention the attachment means comprises at least one clamp able to accept a scaffold bar. Alternatively, the attachment apparatus comprises at least one hook and at least on clamp wherein the hook is able to accept a first scaffold bar and the clamp is able to accept a second scaffold bar. The second scaffold bar may be at least on bar below the first scaffold bar and wherein the second scaffold bar is not more than two bars below the first scaffold bar.

The holding device may be reversibly or permanently affixed to the front side of the base. The holding device may further comprise a holder or clamp able to accept a tool wherein the tool may be an electric power tool.

The another embodiment of the present invention the device further comprises an adapter affixed to the back side. The adapter may be able to accept a communication device such as a cellular phone or a hand held radio.

In yet another embodiment of the present invention the device further comprises a storage pocket affixed to the holding device or the front side of the base. The device may further comprise a storage pocket affixed to the back side of the base.

In one aspect of the present invention a method for securing a tool to a scaffold is disclosed comprising connecting a tool to the front side of the device and attaching the device to a scaffold.

In another aspect of the present invention a kit for securing a tool to a scaffold is disclosed comprising a base, an attachment device, and a holding device. The kit may further comprise an adapter able to accept a communication device or a storage pocket.

DETAILED DESCRIPTION OF THE INVENTION

In accordance with the present invention a device (10) for securing a tool to a scaffold is disclosed comprising a base (12) having a front side and a back side, an attachment apparatus (14,16) affixed to the back side for attaching the base to a scaffold, and a holding device (18) connected to the front side and able to accept a tool.

The base (12) may be constructed in a variety of shapes and sizes, and its desired form may depend on the type and number of tools to be held. For example, a device (10) for securing an electric powered jigsaw may be larger than the jigsaw but smaller than a device (10) for securing an electric powered drill. Additionally the size and shape will depend on the number and types of tools to be held on the base (12). For example a device (10) for securing a hammer and a set of screwdrivers to a scaffold may be larger than a device (10) for securing solely a hammer. Preferably the dimensions of the base (12) are larger than the dimensions of the tool being held.

The base (12) may be constructed of a rigid material able to withstand the force exerted by a tool held by the device (10) while attached to a scaffold. The base (12) may be form molded from metal or polymer plastic or cut from stock material such a sheet metal or polymer plastic sheets.

The base (12) may further comprise a handle such that the device (10) may be carried up the scaffold by hand. The handle may be an opening cut in the base (12) that is of a size able to accept a hand or constructed from a variety of materials able to suspend the device (10) while tools are held such as metal, polymer plastic, nylon or leather. The handle may be affixed to the base (12) in any way such as for example by rivet.

The attachment apparatus may be any apparatus able to reversibly affix the back side of the base (12) to a scaffold. The apparatus may be permanently or reversibly affixed to the base (12). Examples of attachment apparatuses that may be utilized in the present invention include a hook (14), a clamp (16), or a combination comprising a hook (14) and a clamp (16). The attachment apparatus may be made of any material able to maintain its structural integrity when the weight of a tool is held to the device (10) such as for example metal, metal alloy or polymer plastic.

In one configuration the attachment apparatus is a hook (14), or more than one hook (14) wherein the straight portion of the hook (14) is affixed to the back side of the base (12) and the curved portion of the hook (14) is in contact with the scaffold such that the base (12) hangs from the scaffold bar. The hook (14) may be affixed to the base (12) permanently such as by rivet, detachably such as by nut and bolt or rotatably such that the hook (14) or hooks (14) may swivel. In addition, the hook (14) may be adjustably connected such that the hook (14) may slide along a track. When the hook (14) slides along a track the track may be permanently affixed to the back side and the hook (14) may slide vertically. When the hook (14) slides along a track it may be locked in place such as by a screw or by a push lock such that when the push lock is pushed the hook (14) may freely slide within the track and when released the hook (14) is locked in position. Alternatively the hook (14) may have a slot along its straight portion which enables the user to extend or contract the hook (14) or hooks (14) to a desired length.

In another configuration the attachment apparatus may be at least one clamp (16) wherein the clamp (16) is affixed to the back side and reversibly connects the base (12) to the scaffold. The clamp (16) may be stationarilly or rotatably affixed to the base (12) and may be a single piece preferably constructed from a semi-rigid material. When there is more than one clamp the clamps may be of the same or different types such that the device may be utilized with a variety of scaffold bars. It may be attached to a scaffold by pushing the clamp (16) towards the scaffold bar until the clamp (16) engages the bar and removed by pulling the base (12) away from the scaffold bar until the clamp (16) disengages. The clamp (16) may be made of a variety of materials including for example flexible metal alloy or flexible polymer plastic.

Alternatively the clamp (16) may have one fixed portion and one adjustable portion wherein the clamp (16) is engaged by inserting the scaffold between the fixed and adjustable portions. The adjustable portion may be tightened or loosened by a screw whereby the clamp (16) is tightened by rotating the screw in either a clockwise or a counter-clockwise direction and removed by rotating the screw in the opposite direction. In contrast the clamp (16) may be spring activated such that the clamp (16) engages the scaffold by a squeeze and release technique. In this configuration the jaws of the clamp (16) are pivotally connected at the base (12), and the adjustable portion comprises a lever wherein the lever is in contact with the stationary jaw by a spring which exerts pressure pushing the lever away from the jaw forcing the adjustable jaw toward the stationary jaw effectively closing the clamp (16). When the lever is pushed toward the stationary jaw the spring is compressed and the adjustable jaw is drawn away from the stationary jaw effectively opening the clamp (16). The portion is then released allowing the spring to expand thereby attaching the clamp (16) to the scaffold.

In yet another configuration the attachment device comprises a hook (14) and a clamp (16). In this configuration the hook (14) is in contact with a first bar and the clamp (16) is affixed to a second bar located below. Most preferably two hooks (14) are positioned generally parallel to one another and in contact with the first bar and two clamps (16) are positioned generally parallel with one another are in contact with the second bar below the first bar.

The holding device (18) may be any device (18) able to hold a tool to the front side of the base (12) and may be provided in a variety of configurations such as for example a clamp or a holster. Preferably, there may be more than one holding device (18) affixed to the base (12) for holding tools such as one for an electric power drill and one for a hammer. In addition, there may be an array of holding devices (18) that hold a series of tools in varying sizes such as a series of wrenches, screwdrivers, or drill bits.

When the holding device (18) is a clamp (20) a variety of clamps may be utilized that are able to clasp a tool. The clamp (20) may clasp the tool along the tool's body or along the tool's handle. Preferably, there is more than one clamp (20). For example if there are two clamps (20), one may hold the body of a tool and the other may hold the handle to secure the tool to the base. Furthermore, the clamp (20) may be constructed as a single piece or may comprise two or more pieces.

When the clamp (20) is constructed as a single piece it may be made of a semi-rigid material allowing a tool to be engaged by pressing the tool into the clamp and removed by pulling the tool away from the clamp. For example, the clamp (20) may be constructed of a flexible metal alloy or a flexible polymer plastic.

When the clamp (20) is constructed of two or more pieces it may operate by having one fixed portion and one movable portion wherein the movable portion may be adjusted such that the tool is held between the fixed and movable portions. The fixed portion may be constructed of a rigid material such as metal, metal alloy, or rigid plastic. The movable portion may be a rigid structure or a flexible structure. When the movable portion is a rigid structure it may be constructed of material such as metal, metal alloy, or a rigid plastic, and may adjusted by movement of the entire portion such as by rotating a screw that adjusts the distance between the fixed portion and movable portion. When the movable portion is a flexible structure it may be constructed of any semi-rigid material able to flex when the tool is pressed into the clamp and when the tool is removed from the clamp (20) yet retain a rigid conformation when the tool is held.

When the holding device (18) is a holster the holster may be any device that functions by resting the tool within the holster reservoir. The size and conformation of the holster will depend on the tool to be placed within a reservoir. The holster may be constructed of a rigid or flexible material. If a rigid holster is preferred it may be made of, for example, rigid molded polymer plastic. When a flexible material is desired the holster may be made of a flexible polymer plastic or leather. The holster may further comprise a locking strap that secures the tool within the holster. The locking strap may begin on one of two opposing sides of the holster above the reservoir, wrapping across the tool or through its handle, and reversibly affixed on the other opposing side of the holster such as by a snap or other securing mechanism. The locking strap may be made of a semi-rigid material such as leather or made of an elastic material such as an elastic cord.

The device (10) may further comprise an adapter (22) affixed to the back side of the device (10) allowing items to be reversibly affixed to back side of the device (10). When the adapter (22) is affixed to the back side of the base it is situated so as not to interfere with the operations of the attachment apparatus. The adapter (22) may be a clip, a strap, or a pocket.

The device (10) may further comprise a storage pocket (24) affixed to the front side or the back side of the base (12). The storage pocket (24) may be constructed in a variety of configurations such that a variety of items may be stored such as for example personal items like keys and wallets may be stored in the pocket or alternatively work items such as drill bits, nails, screws and rivets may be stored in the pocket. The storage pocket (24) may be permanently affixed to the base (12) such as by rivets or adhesive or reversibly affixed to the base such as by straps or VELCRO™.

A method for securing a tool to a scaffold is disclosed comprising connecting a tool to the front side of the device (10), and attaching the device (10) to a scaffold. When the device (10) has a fixed attachment apparatus such as at least one hook (14), the device (10) may be hung on a desired scaffold bar at a location close to the working area. When the device (10) comprises at least one clamp (16) the device (10) may be clamped onto a desired scaffold bar at a location close to the working area. When the device (10) has an adjustable attachment apparatus it may be affixed to a number of scaffolds by a variety of methods for example, if the securing device has a combination of at least one adjustable hook (14) and at least one clamp (16), the device (10) may be clamped on a lower scaffold bar and the hook (14) or hooks (14) may be adjusted to engage a scaffold bar above. Correspondingly, the adjustable hook (14) or hooks (14) may be placed on a scaffold bar, the clamps (16) engaged on a lower bar and the hook or hooks then adjusted to securely affix the device (10) to the scaffold.

A kit for securing a tool to a scaffold is disclosed comprising a base (12), an attachment apparatus (14,16), and a holding device (18). The base (12), attachment apparatus (14,16), and holding device (18) may be in any configuration as previously described. In addition the kit may further comprise an adapter able to accept a communication device or may further comprise a storage pocket. Similarly the adapter and storage pocket may be in any configuration as previously described.

I claim:

1. A device for securing a tool to a scaffold consisting of:

a) a planar base having a front side surface and a back side;

b) an attachment apparatus having at least one upper hook and a lower clamp affixed to said back side for attaching said base to said scaffold; and c) a holding device connected to said front side surface for receiving said tool and securing means to secure said tool within said holding device.

2. The device according to claim 1 wherein said at least one hook is adjustably affixed to said back side.

3. The device according to claim 1 wherein said attachment apparatus comprises at least one hook and at least one clamp wherein said hook is able to accept a first scaffold bar and said clamp is able to accept a second scaffold bar.

4. The device according to claim 1 wherein said holding device is permanently affixed to said front side surface.

5. The device according to claim 1 wherein said holding device comprises a holster for receiving said tool.

6. The device according to claim 1 wherein said holding device comprises a clamp for receiving a tool.

7. The device according to claim 1 further comprising an adapter affixed to said back side.

8. The device according to claim 7 wherein said adapter is able to accept a communication device.

9. The device according to claim 8 wherein said communication device is a cellular phone or a hand held radio.

10. The device according to claim 1 further comprising a storage pocket affixed to said holding device or said front side surface of said base.

11. The device according to claim 1 further comprising a storage pocket affixed to said back side.

12. A method for securing a tool to a scaffold comprising:

a) providing a device consisting of a planar base having a front side surface and a back side; an attachment apparatus affixed to said back side for attaching said base to said scaffold; and a holding device connected to said front side surface for receiving said tool and securing means to secure said tool within said holding device;

b) affixing said tool to said front side surface of said holding device; and c) attaching said device to said scaffold.

13. A kit for securing a tool to a scaffold comprising:

a) a planar base having a front side surface and a back side;

b) an attachment apparatus having at least one upper hook and a lower clamp affixed to said back side for attaching said base to said scaffold; and c) a holding device connected to said front side surface for receiving said tool and securing means to secure said tool within said holding device.

14. The kit according to claim 13 further comprising an adapter able to accept a communication device affixed to said planar base or said holding device.

15. The kit according to claim 14 further comprising a storage pocket affixed to said planar base.

* * * * *